US006719013B1

(12) United States Patent
D'Estais

(10) Patent No.: US 6,719,013 B1
(45) Date of Patent: Apr. 13, 2004

(54) BEAD-WEAVING SYSTEM

(75) Inventor: Mathias D'Estais, Cairon (FR)

(73) Assignee: Heller S.A. (FR)

( * ) Notice: Subject to any disclaimer, the term of this patent is extended or adjusted under 35 U.S.C. 154(b) by 24 days.

(21) Appl. No.: 10/015,347

(22) Filed: Dec. 12, 2001

(30) Foreign Application Priority Data

Dec. 12, 2000 (FR) ..... 00 16185
Dec. 12, 2000 (FR) ..... 00 16186
Dec. 12, 2000 (FR) ..... 00 16184

(51) Int. Cl.[7] ..... D03D 29/00

(52) U.S. Cl. ..... 139/29; 139/30; 139/31; 139/32; 139/33; 139/33.5; 139/34; 223/48

(58) Field of Search ..... 139/29, 30, 31, 139/32, 33, 33.5, 34; 223/48, 102, 103, 104, 109 R; 66/116, 117, 118, 123, 124

(56) References Cited

U.S. PATENT DOCUMENTS 1,726,933 A * 9/1929 St. John ..... 223/48
2,043,082 A * 6/1936 Wallach ..... 28/151
2,601,222 A * 6/1952 Wehrli ..... 28/151
3,678,712 A * 7/1972 Singleton ..... 66/118
3,907,180 A * 9/1975 Birk et al. ..... 223/48
4,044,446 A 8/1977 Segerman
5,395,245 A * 3/1995 Heinz ..... 434/204
5,494,734 A 2/1996 Widders
5,664,707 A * 9/1997 Spector ..... 223/48

FOREIGN PATENT DOCUMENTS

DE 31 005 C 5/1884
DE 3144 224 A 6/1982
GB 442265 A 2/1936
JP 08-060490 A 3/1996

* cited by examiner

*Primary Examiner*—John J. Calvert
*Assistant Examiner*—Robert H. Muromoto, Jr.
(74) *Attorney, Agent, or Firm*—Piper Rudnick LLP

(57) ABSTRACT

A bead-weaving system including a multiplicity of beads for spacing apart a multiplicity of warp threads, wherein the beads are pierced by a hole in their diameter and threaded on a weft thread by a needle and positioned between each warp thread, the needle having a body including an end portion having an eye for passage of a weft thread and another end portion including a bead holder extending along the another end portion to hold the beads in selected positions along the another end portion and a point.

11 Claims, 7 Drawing Sheets

Fig.2.1
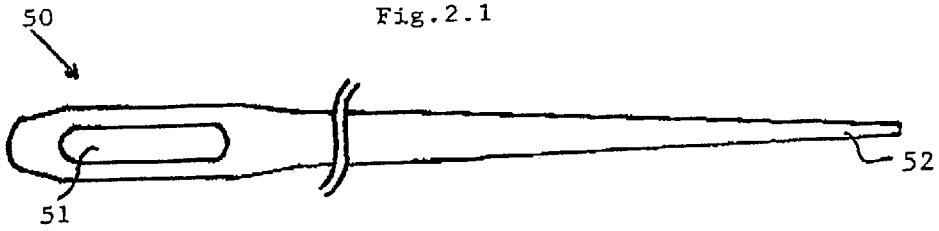
Fig.2.2
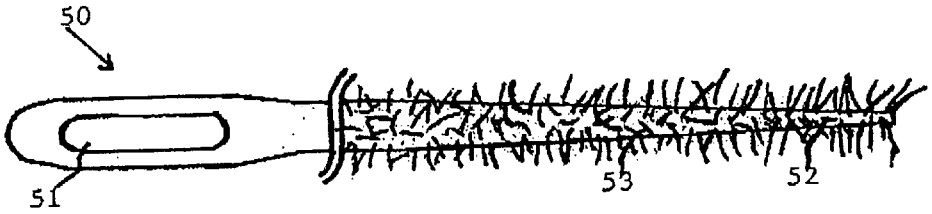
Fig.2.3
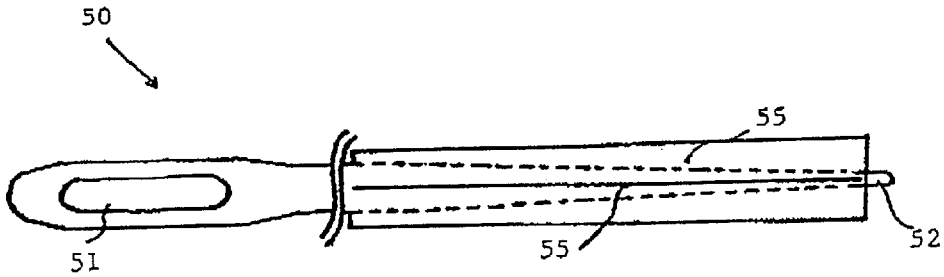
Fig.2.4
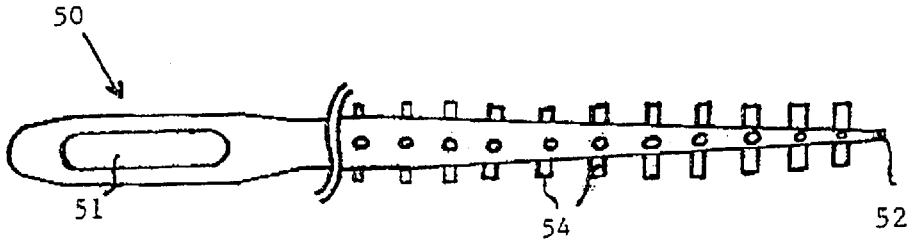

Fig.3.3
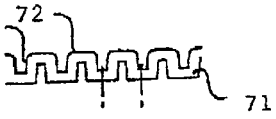
SECTION C-C
detail scale 2
Fig.3.2
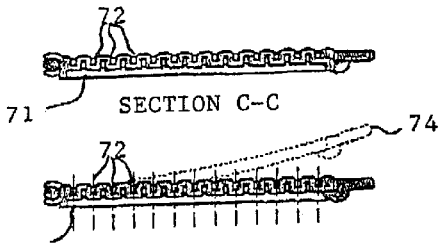
SECTION C-C
SECTION B-B
Fig.3.4
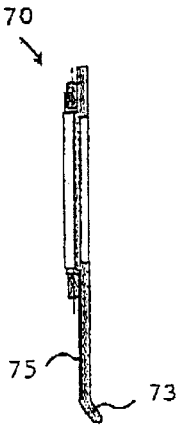
SECTION A-A
Fig.3.1
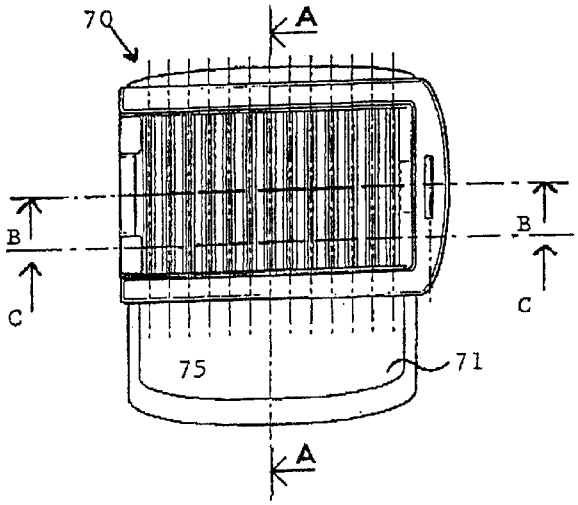

Fig.4.1
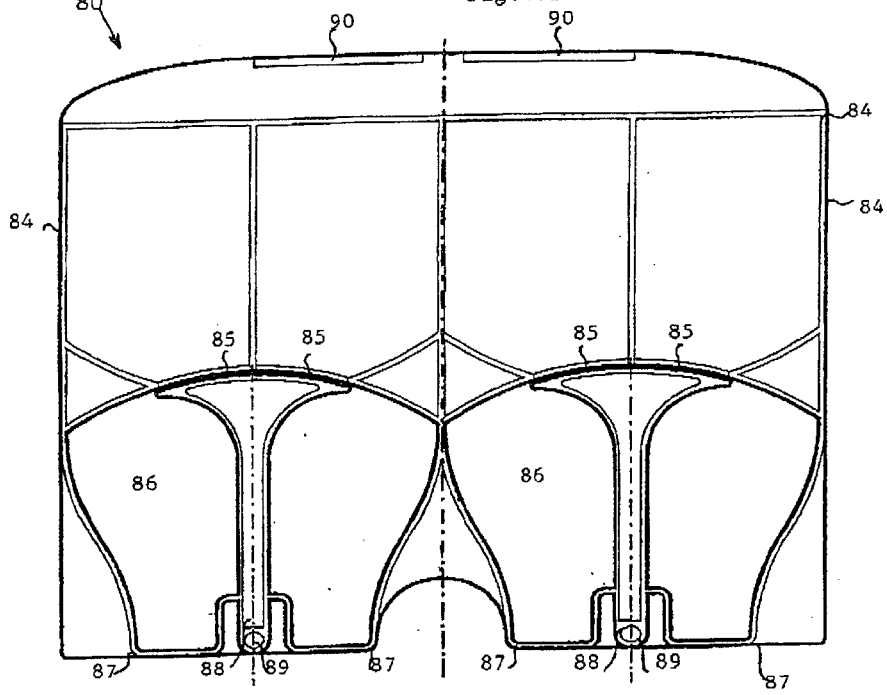
Fig.4.2
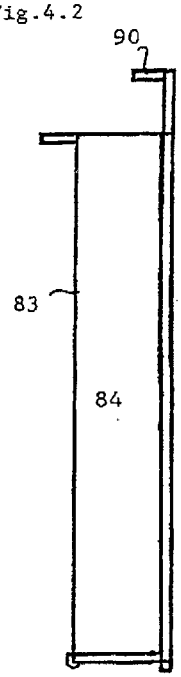
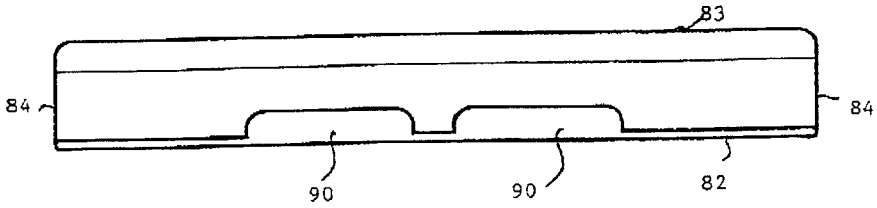
Fig.4.3

Fig.5.1
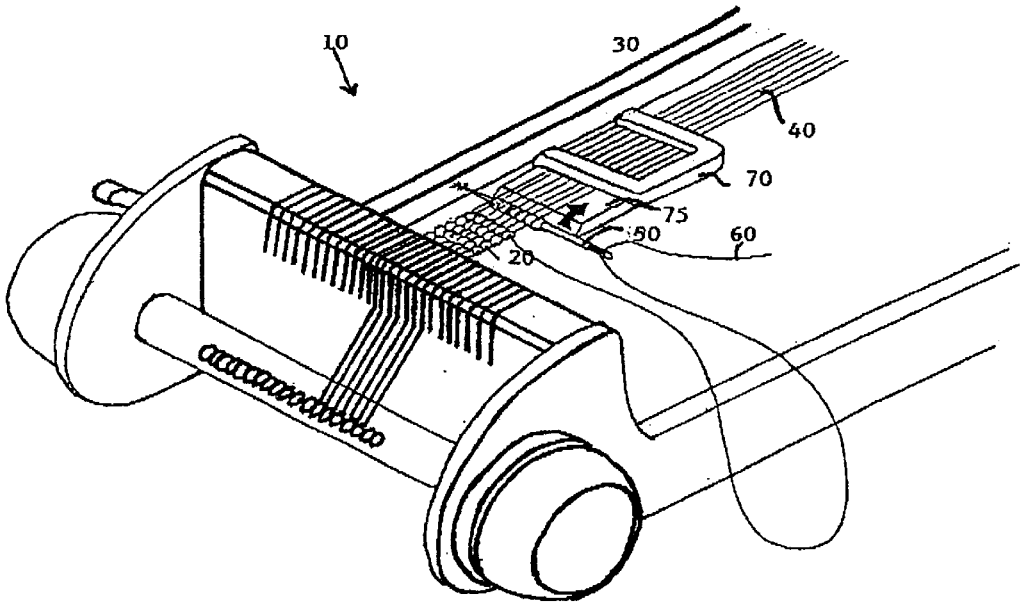
Fig.5.2
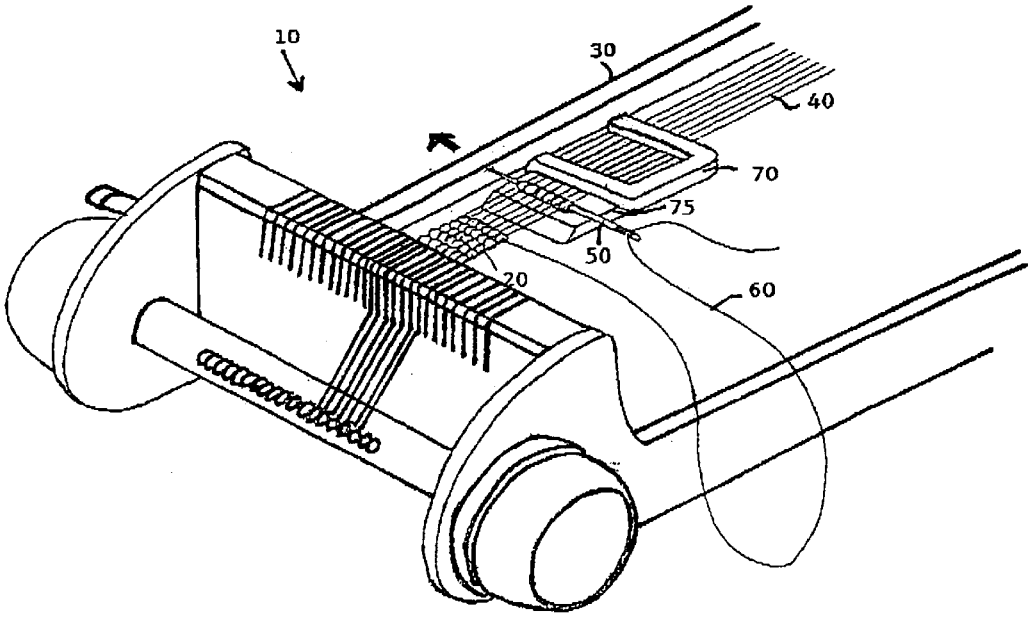

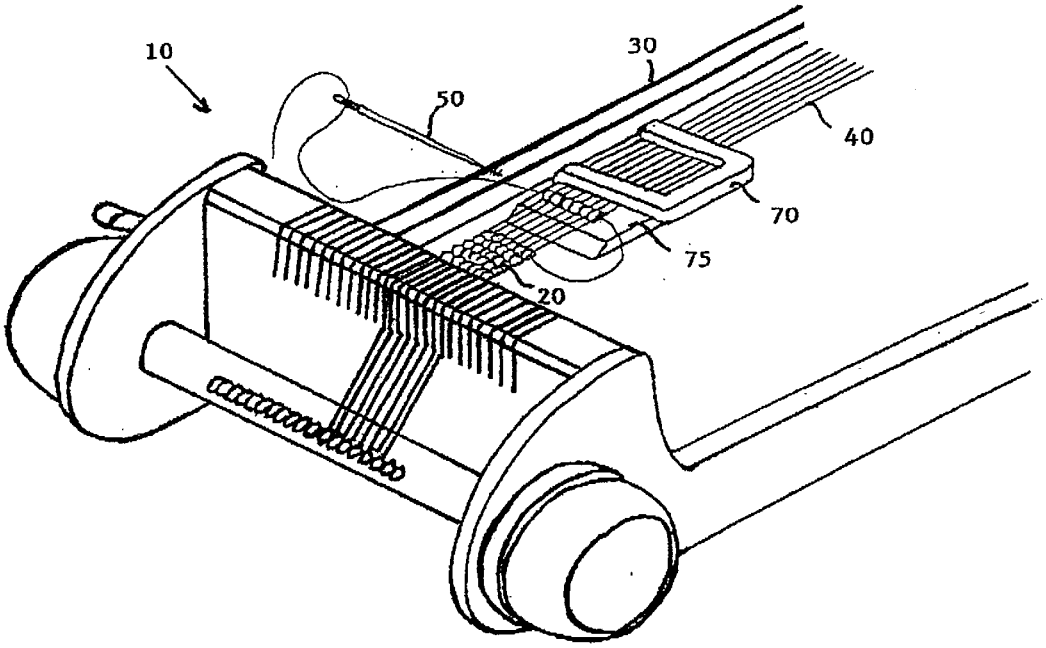
Fig.5.4
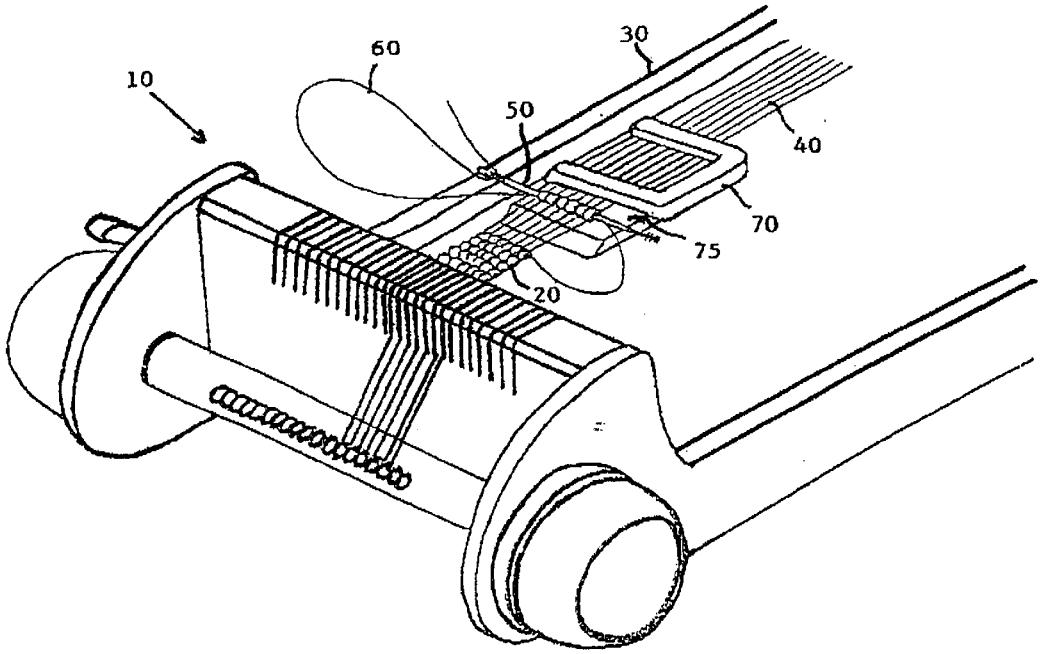

Fig.5.5
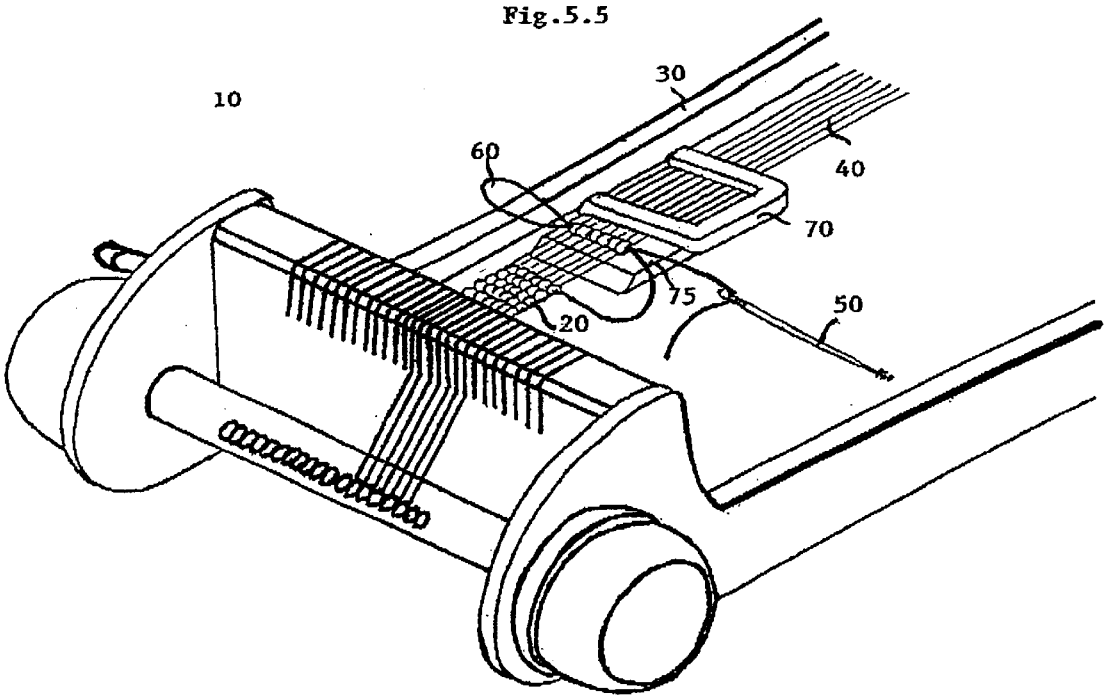

BEAD-WEAVING SYSTEM

FIELD OF THE INVENTION

The present invention pertains to the field of bead weaving.

More specifically, the present invention pertains to a bead-support device for a bead-weaving system, a needle for a weaving system and a storage device for a bead-weaving system.

PRIOR ART

Traditionally, bead weaving—whether on a recreational, handicraft or industrial basis—has been performed by hand and requires a particular dexterity.

In order for the beads to be held in position, it is necessary to perform a forward weaving and a return weaving of the weft thread, transversely to the warp threads.

This operation is problematical especially when implementing the return weaving because it is necessary that the holes in the beads be correctly aligned so as to allow passage of the weft thread in each of the holes of the beads.

Furthermore, the operation of threading the beads on the needle becomes more difficult because the beads that have already been threaded must be held back with a finger so that they do not fall off due to gravity when it is desired to thread additional beads.

Making available the beads also creates problems since it is necessary to be able to easily choose the sufficient quantity of beads of the desired color during the bead selection phase, since the bead-stitching phase requires having available an adequate surface and since it is also necessary to have available means for storing the unused beads.

SUMMARY OF THE INVENTION

The goal of the present invention is to resolve the drawbacks of the prior art by proposing a system to facilitate the weaving and to enable easy production of the products, without particular concern for dexterity, by facilitating selection of the beads, their stitching and the storage after weaving of the unused beads.

Thus, the present invention pertains to a bead-weaving system comprising means for spacing apart a multiplicity of warp threads, each of said beads being pierced by a hole through their diameter and intended to be threaded on a weft thread by means of a needle and to be positioned between each warp thread.

The bead-support device is constituted, in its broadest sense, of a baseplate intended to be positioned under the warp threads so as to maintain said beads during the forward weaving and the return weaving of said weft thread transversely to said warp threads.

The needle, in its broadest sense, presents a body comprising at one end an eye for passage of a weft thread and at the other end a point comprising means for holding said beads.

The bead-weaving system comprises at least one bin presenting, in its broadest sense, a multiplicity of walls as well as at least one opening provided on a wall and equipped with a closing means, with the opening of said bin feeding over a receiving tray with rims to make available the at least partial content of said bin and to concentrate the reentering flow when storing in the interior of said bin.

Said baseplate of the bead-support device preferably comprises a return end. Said baseplate also preferably comprises means making possible suspension of said bead-support device on the warp threads. Said means enabling suspension of said bead-support device on said warp threads are preferably constituted by a band of material that can be positioned across said warp threads. Said base preferably presents at least partially an unsmooth surface as well as means for the regular spacing apart of said warp threads. Said regular spacing means can be constituted by a multiplicity of regularly spaced apart cavities in which can be positioned the free parts of the warp threads.

Thus, the bead-support device facilitates the weaving of the weft thread and enables easier and more rapid weaving operations.

The free diameter of the needle's holding means is between 110 and 200%, preferably on the order of 140%, of the average internal diameter of said holes. In one variant, said holding means are constituted by a flocking. In another variant, said holding means are constituted by a multiplicity of barbs. In another variant, said holding means are constituted by a multiplicity of strips. Said strips are longitudinal, transverse or helicoid. The point of the needle is preferably blunt.

Thus, due to the holding means, the beads that have already been threaded on the needle are maintained, the previously threaded beads do not interfere with the threading of additional beads and it is much easier to thread additional beads.

The bin's receiving tray preferably has an unsmooth covering. This unsmooth covering is preferably constituted by felt. The receiving tray can be located, for example, in the extension of a base wall of the bin. In one variant, said bins are arranged in pairs with each pair of bins fitted with a single receiving tray and a single shutter which can be moved between a position in which the first opening is free, a position in which both openings are blocked and a position in which the second opening is free. The shutter preferably separates said receiving tray into two compartments. This shutter has either the form of a rigid hammer whose handle is mounted in a mobile manner on a shaft or in the form of a flexible, deformable hammer. The storage device is preferably constituted of two parts, with the bin bottom and the receiving tray forming a first part and the top wall and the lateral walls of the bin, plus the shutter and the rims of the receiving tray forming a second part.

Thus, the storage device according to the invention, with its receiving tray system, makes available a surface which is both a display surface facilitating the threading of the beads in a delimited zone and also a surface facilitating the storage, equipped with rims converging toward the opening of the recipient(s).

Thus, likewise, the storage device according to the invention is very simple to implement and inexpensive, especially in its variant of paired bins, each dosed by a single shutter forming separation of the receiving tray into two compartments.

BRIEF DESCRIPTION OF THE DRAWINGS

Better comprehension of the invention will be obtained from the description below of one mode of implementation of the invention, presented for purely explicative purposes with reference to the attached figures:

FIGS. 2.1 to 2.4 illustrate front views of different variants of implementation of the needle;

FIGS. 3.1 to 3.5 illustrate different views of the bead-support device;

FIGS. 4.1 to 4.3 illustrate different views of the storage device;

FIGS. 4.4 to 4.6 illustrate different views of the use of the storage device, the top wall of which has been artificially removed; and FIGS. 5.1 to 5.5 illustrate different views of the use of the bead-support device.

DETAILED DESCRIPTION OF THE INVENTION

Figure 1:
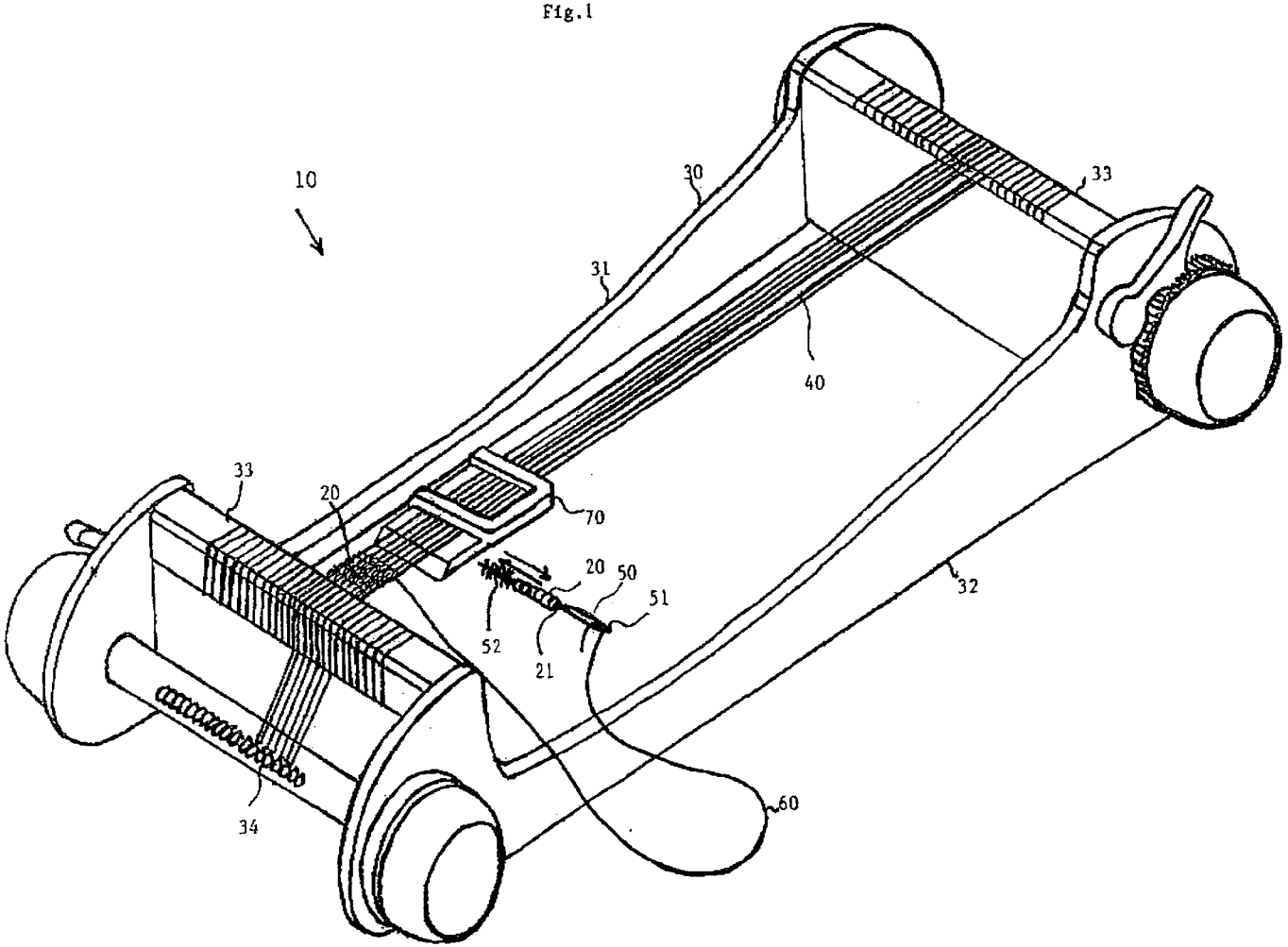
FIG. 1 illustrates a perspective view of the bead-weaving system.

The system (10) according to the invention, shown in FIG. 1, is a system for weaving beads (20).

The system (10) comprises at least one frame (30) for the implementation of a multiplicity of warp threads (40) and a needle, which can be connected to a weft thread (60), such that said beads (20) can be threaded.

The system (10) comprises means enabling the spacing apart of a multiplicity of warp threads (40).

The frame (30) presents lateral flanks (31, 32) as well as at least one transverse guide (33) and preferably two transverse guides (33), composing a succession of cavities and protrusions, with the cavities being intended to receive the warp threads (40).

The frame (30) also comprises means (34) for attaching the ends of the warp threads (40).

Said beads (20) are pierced by a hole (21) through their diameter (22) and are intended to be threaded on a weft thread (60).

The needle (50) presents a body comprising at one end an eye (51) for passage of a weft thread (60) and at the other end a point (52), as shown in FIG. 2.1.

The needle (50) comprises means for holding said beads (20).

The overall length is on the order of 60 millimeters.

The point (52) is preferably slightly conical over approximately 6 millimeters and blunt, so as to make it less dangerous, especially for children; the eye has a length of at least 2 millimeters so as to facilitate passage of the weft thread (60).

The weft thread (60) is maintained on the needle (50) by being threaded in the eye (51).

The beads (20) are threaded on the needle (30) via the point (52) and are then threaded on the weft thread (60). It is therefore necessary that the outside diameter of the needle (50) be smaller than the inside diameter of the holes (21) in the beads (20).

The needle (50) comprises means for temporarily holding said beads (20) at least at its point (52), or over almost the entirety of its surface or in fact over the entirety of its surface. These holding means are designed to cooperate with the inside surface of the holes (21) in the beads (20) so as to simplify the stitching of the beads but enabling their retention along the length of the body of the needle without manual intervention.

The free diameter of the holding means is between 110 and 200%, preferably on the order of 140%, of the average internal diameter of said holes (21).

These holding means can be constituted, for example, by a flocking (53), i.e., the gluing on to he surface of the needle of very small viscose fibers or of another fibrous material, with these fibers being oriented essentially perpendicular to the axis of the needle as shown in FIG. 2.2.

The holding means can also be constituted, for example, by a multiplicity of longitudinal, transverse or helicoid strips (55). When the strips (55) are longitudinal, as shown in FIG. 2.3, they create a sort of feathering. When they are essentially concentric with the body of the needle (50) and when they are helicoid, they create a sort of screw thread.

These holding means can also be constituted, for example, by a multiplicity of cylindrical barbs (54) as shown in FIG. 2.4. These semirigid barbs (54) can be created by molding material which is attached on to the body of the needle (50) or injected simultaneously upon creation of the body of the needle by injection of plastic.

In one version of the invention, the system (10) moreover comprises at least one bead-support device (70) constituted by a baseplate (71) intended to be positioned under the warp threads (40) so as to enable maintaining said beads (20) during the forward weaving and return weaving of said weft thread (60) transversely to said warp threads (40) as shown successively in FIGS. 5.1 to 5.5

This device is intended to Stain the beads (20) aligned between the warp threads (50) for weaving the weft thread (60) in one transverse direction as shown in FIGS. 5.1 and 5.2, and then in the other transverse direction as shown in FIGS. 5.3 to 5.5.

The baseplate (71) presents means for the regular spacing apart of said warp threads (40) constituted, for example, by a multiplicity of regularly spaced apart cavities (72) in which can be positioned the free parts of the warp threads (40) as shown in fires 3.1, 3.2 and 3.3.

The baseplate (71) also has a return end (73) as shown in FIG. 3.4.

Thus, in order to position the needle (50) carrying the beads (20) and linked to the weft thread (60), it is necessary to slightly raise the warp threads (40) so as to be able to slide the needle (50) beneath them as shown in FIG. 5.1, The baseplate (71) comprises means enabling suspension of the bead-support device (70) on said warp threads (40) constituted, for example, by a band of material (74) that can be positioned across said warp threads (40) as shown in FIG. 3.5. Thus, the bead-support device (70) is removable.

The bead-support device (70) can also be completely integrated in the frame (30) or totally separate from the frame (30).

The bead-support device (70) is preferably positioned downstream of the work in progress.

The base (71) of the bead-support device (70) presents at least partially an unsmooth surface (75) made, for example, by flocking or constituted of felt so as to prevent the beads (20) from rolling.

In one version of the invention the system (10) moreover comprises a storage device (80) of the type comprising at least one bin (81) presenting a bottom wall (82), a top wall (83) and side walls (84) as shown in elevation in FIG. 4.1 and in side view in FIG. 4.2.

The bin (81) comprises at least one opening (85) in a side wall (84) and opening onto a receiving tray (86) comprising rims (87) to make available the at least partial content of said bin (81) and to concentrate the reentering flow when storing in the interior of said bin (81).

The receiving tray (86) is positioned in the extension of the bottom wall (82).

The receiving tray (86) thus facilitates both the filling and the extraction of the contents of said bin (81).

The receiving tray (86) comprises an unsmooth covering made, for example, by flocking or constituted of felt so as to facilitate the stitching of the beads (20) and their threading on the needle (50) as shown in FIG. 4.6. In fact, said unsmooth covering facilitates the positioning of the beads such that the axes of their holes are perpendicular to the receiving tray (86).

The opening (85) is fitted with a closing means.

Said bins (81) are arranged in pairs and each pair of bins (81) is equipped with a single receiving tray (86) and a single shutter (88) which can be moved between a position in which the first opening (85) is free, shown in FIG. 4.5, a position in which both openings (85) are blocked, shown in FIG. 4.4, and a position in which the second opening (85) is free, not illustrated.

The shutter (88) separates said receiving tray (86) into two compartments.

This shutter (88) can present the form of a rigid hammer whose handle is mounted in a mobile manner on a shaft (89) as shown in FIG. 4.1.

Thus, to discharge beads (20) stored in a bin (81), it is sufficient to move the shutter (88) on its shaft (89) so as to unblock the opening (85), then slide out the beads (20) onto the receiving tray (86) and then return the shutter (88) to its initial position. Means of the spring type can be provided such that this return to the initial position is automatic.

In order to store the beads (20) in their bins (81), it is sufficient to move the shutter (88) in the opposite direction and to slide the beads to the opening (85) or to tilt up the storage device (80).

The shutter (87) can also present the form of a flexible, deformable hammer, which is displaced in an essentially similar manner.

The bins (81) preferably comprise colored markers or transparent windows so that the color of the beads stored within can be determined.

The storage device (80) can preferably be attached to the frame (30) by means, for example, of clips (90) as shown in FIGS. 4.1 and 4.3.

The storage device (80) is preferably made by injection of plastic. The bottom (82) of the bin (81), the receiving tray (86) and the shaft (89) form a first part and the remainder of the storage device (80), i.e., the top wall (83) and the side walls (84) of the bin (81), as well as the shutter (88) and the rims (87) of the receiving tray (86) form a second part.

The invention is described above as an example. It is understood that the expert in the field could implement different variants of the invention without departing from the scope of the patent.

What is claimed is:

1. A bead-weaving system comprising means for spacing apart a multiplicity of warp threads, and a needle having a body comprising at one end an eye for passage of a weft thread and at another end a point comprising means extending along said another end for holding beads in selected locations on the needle, said beads being pierced by a hole through their diameter and intended to be threaded on a weft thread by means of said needle and to be positioned between each warp thread.

2. The bead-weaving system according to claim 1, wherein a free diameter of the holding means is between 110 and 200%, of the average internal diameter of said holes.

3. The bead-weaving system according to claim 1, in which said hold means are constituted by a flocking.

4. The bead-weaving system according to claim 1, in which said hold means are constituted by a multiplicity of barbs.

5. The bead-weaving system according to claim 1, in which said hold means are constituted by a multiplicity of strips.

6. The bead-weaving system according to claim 5, in which said strips are longitudinal.

7. The bead-weaving system according to claim 5, in which said strips are transverse.

8. The bead-weaving system according to claim 5, in which said strips are helicoid.

9. The bead-weaving system according to claim 1, in which said point is blunt.

10. A bead-weaving system comprising a multiplicity of beads for spacing apart a multiplicity of warp threads, wherein said beads are pierced by a hole in their diameter and threaded on a weft thread by a needle and positioned between each warp thread, said needle having a body comprising an end portion having an eye for passage of a weft thread and another end portion comprising a bead holder extending along the another end portion to hold said beads in selected positions along the another end portion and a point.

11. A needle for use in a bead-weaving system, wherein a multiplicity of beads spaced apart multiplicity of warp threads comprising an end portion having an eye for passage of a weft thread and another end portion comprising a bead holder extending along the another end portion to hold said beads in selected positions along the another end portion and a point.

* * * * *